US007165692B2

(12) United States Patent
Konefal et al.

(10) Patent No.: US 7,165,692 B2
(45) Date of Patent: Jan. 23, 2007

(54) CHILD-RESISTANT CLOSURE AND CONTAINER PACKAGE

(75) Inventors: Robert S. Konefal, Wilton Centre, NH (US); Steven R. Wolfe, Maumee, OH (US)

(73) Assignee: Owens-Illinois Prescription Products Inc., Perrysburg, OH (US)

( * ) Notice: Subject to any disclaimer, the term of this patent is extended or adjusted under 35 U.S.C. 154(b) by 341 days.

(21) Appl. No.: 10/768,374

(22) Filed: Jan. 30, 2004

(65) Prior Publication Data

US 2005/0269280 A1 Dec. 8, 2005

(51) Int. Cl.
*B65D 55/02* (2006.01)
*B65D 41/06* (2006.01)

(52) U.S. Cl. ..... 215/220; 215/228; 215/43; 215/332; 215/321

(58) Field of Classification Search ..... 215/43, 215/223, 228, 321, 332, 220, 221, 222, 335
See application file for complete search history.

(56) References Cited

U.S. PATENT DOCUMENTS

| | | | | |
|---|---|---|---|---|
| 183,890 | A | 10/1876 | Block | |
| 2,817,453 | A | 12/1957 | Stover | |
| 3,381,838 | A | 5/1968 | McClain | |
| 3,567,057 | A * | 3/1971 | Landen | 215/221 |
| 3,659,735 | A | 5/1972 | Landen | |
| 4,057,159 | A | 11/1977 | Fillmore | |
| 4,059,198 | A | 11/1977 | Mumford | |
| 4,103,797 | A | 8/1978 | Morris | |
| RE29,779 | E | 9/1978 | Morris | |
| 4,452,364 | A * | 6/1984 | Kay | 215/253 |
| 4,485,932 | A | 12/1984 | Kusz | |
| 4,526,281 | A | 7/1985 | Herr | |
| 4,579,238 | A * | 4/1986 | Herr | 215/211 |
| 5,464,110 | A | 11/1995 | Heyworth | |
| 5,497,879 | A | 3/1996 | Kao | |
| 5,638,971 | A | 6/1997 | Justesen | |
| 5,899,348 | A | 5/1999 | Konefal | |
| 6,161,711 | A | 12/2000 | Miceli | |
| 6,260,723 | B1 | 7/2001 | Bergholtz | |
| 2001/0035388 | A1 | 11/2001 | Miceli et al. | |

* cited by examiner

*Primary Examiner*—Nathan J. Newhouse
*Assistant Examiner*—James Smalley

(57) ABSTRACT

A child-resistant closure and container package includes a container having an open end surrounded by a cylindrical wall with a central axis, a plurality of circumferentially spaced projections extending radially outwardly from an outer surface of the wall adjacent to the open end, notches on undersides of the projections, and a plurality of circumferentially spaced flexible resilient spring elements extending radially outwardly from the outer surface of the cylindrical wall and angularly disposed between the projections. A closure includes a base wall, a cylindrical skirt extending from the base wall to an axial edge spaced from the base wall, a plurality of circumferentially spaced lugs extending radially inwardly from the skirt, and a circumferentially continuous annular wall extending axially from the base wall coaxially with and spaced radially inwardly from the skirt. The axial edge of the skirt is adapted for axial edge abutment with the spring elements on the container to urge the lugs axially into the notches, with the annular wall being in internal plug-sealing engagement with the open end of the container. Removal of the closure requires axial movement of the closure against the spring elements and rotation of the closure to move the lugs out of the notches and clear the projections.

13 Claims, 3 Drawing Sheets

CHILD-RESISTANT CLOSURE AND CONTAINER PACKAGE

Reference is made to application Ser. No. 10/388,293 filed Mar. 12, 2003, Ser. No. 10/386,192 filed Mar. 10, 2003, and Ser. No. 10/684,724 filed Oct. 13, 2003, all assigned to the assignee of the present application.

The present invention relates to child-resistant closure and container packages, such as prescription packages, to closures and containers for such packages, and to methods of making such packages.

BACKGROUND AND SUMMARY OF THE INVENTION

U.S. Pat. No. 4,057,159 discloses a child-resistant closure and container package that includes a container or vial, a closure, and a spring element and a seal disk disposed between the closure and the container. The closure has lugs on an inside surface of a skirt to cooperate with external locking notches on projections around the mouth of the container for securing the closure to the container. An internal abutment on the closure cooperates with the spring element to urge the closure away from the container so that the lugs are resiliently captured within the notches, and to hold the seal disk in engagement with the open edge of the container surrounding the container mouth. When it is desired to remove the closure, the closure must be pushed toward the container so that the lugs clear the notches against the force of the spring element, and then turned counterclockwise. When the closure is assembled to the container, the lugs cam beneath convex surfaces on the projections against the force of the spring element until the lugs snap into the notches on the projections. U.S. Pat. Nos. 4,059,198 and 4,485,932 disclose child-resistant closure and container packages in which the functions of the spring element and the seal disk are combined in a single piece, thus forming a package in the form of a three-piece assembly rather than a four-piece assembly.

It is a general object of the present invention to provide a closure and container package, a closure and a container for use in such a package, and a method of making such a package, in which the package is a two-piece package comprised of the closure and the container. Another and related object of the invention is to provide a closure and container package, a closure and a container for use in such a package, and a method of making such a package in which the closure is adapted to be secured to the container in either a child-resistant or a non-child-resistant mode of operation.

The present invention embodies a number of different aspects that can be implemented separately from or in combination with each other.

In accordance with a first aspect of the present invention, a child-resistant closure and container package includes a container having an open end surrounded by a cylindrical wall with a central axis, a plurality of circumferentially spaced projections extending radially outwardly from an outer surface of the wall adjacent to the open end, notches on undersides of the projections, and a plurality of circumferentially spaced flexible resilient spring elements extending radially outwardly from the outer surface of the cylindrical wall and angularly disposed between the projections. A closure includes a base wall, a cylindrical skirt extending from the base wall to an axial edge spaced from the base wall, a plurality of circumferentially spaced lugs extending radially inwardly from the skirt, and a circumferentially continuous annular wall extending axially from the base wall coaxial with and spaced radially inwardly from the skirt. The axial edge of the skirt is adapted for axial edge abutment with the spring elements on the container to urge the lugs axially into the notches, with the annular wall being in internal plug-sealing engagement with the open end of the container. Removal of the closure requires axial movement of the closure against the spring elements and rotation of the closure to move the lugs out of the notches and clear the projections.

In accordance with another aspect of the present invention, there is provided a closure and container package having child-resistant and non-child-resistant modes of operation. A container has an open end surrounded by a cylindrical wall with a central axis, a plurality of circumferentially spaced projections extending radially outwardly from an outer surface of the wall adjacent to the open end and notches on undersides of the projections. A plurality of circumferentially spaced flexible resilient flat spring elements extend radially outwardly from the outer surface of the container wall in a plane perpendicular to the container axis on an opposite side of the projections from the open end. The flat spring elements are angularly disposed between the projections on the container wall. An internal bead extends around the open end of the container. A closure includes a base wall, a cylindrical skirt extending from a peripheral edge of the base wall to an axial edge spaced from the base wall, and a plurality of circumferentially spaced lugs extending radially inwardly from the skirt. A hollow dome extends axially from the base wall in a direction opposite from the skirt. The dome has an annular sidewall spaced radially inwardly from the peripheral edge of the base wall, and a bead extends radially outwardly from the annular wall at a position spaced from the base wall. A circumferentially continuous annular wall extends axially from the base wall coaxially with and spaced radially inwardly from the skirt. The closure is adapted to be secured to the container in a child-resistant mode of operation with the axial edge of the skirt in axial edgewise engagement with the spring elements to urge the lugs axially into the notches and with the annular wall in internal plug-sealing engagement with the open end of the container. The closure is adapted to be secured to the container in a non-child-resistant mode of operation with the dome received within the open end of the container and the bead on the dome received by snap fit over the internal bead on the cylindrical wall of the container.

A closure of one-piece plastic construction in accordance with a further aspect of the present invention includes a base wall, a cylindrical skirt extending from the base wall to an axial edge spaced from the base wall, a plurality of circumferentially spaced lugs extending radially inwardly from the skirt, and a circumferentially continuous annular wall extending axially from the base wall coaxially with and spaced radially inwardly from the skirt. The closure preferably, but not necessarily, additionally includes a dome having an annular sidewall spaced radially inwardly from the peripheral edge of the base wall, and a bead extending radially outwardly from the annular wall at a position spaced from the base wall.

A container of one-piece plastic construction in accordance with another aspect of the present invention has an open end surrounded by a cylindrical wall with a central axis, a plurality of circumferentially spaced projections extending radially outwardly from an outer surface of the wall adjacent to the open end, notches on undersides of the projections, and a plurality of circumferentially spaced flexible resilient spring elements extending radially outwardly from the outer surface of the wall and angularly disposed between the projections. The spring elements preferably but not necessarily are flat, lie in a plane perpendicular to the axis of the container and are disposed on a side of the projections opposite from the end of the container. The container preferably, but not necessarily, additionally includes an internal bead around the open end of the container.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
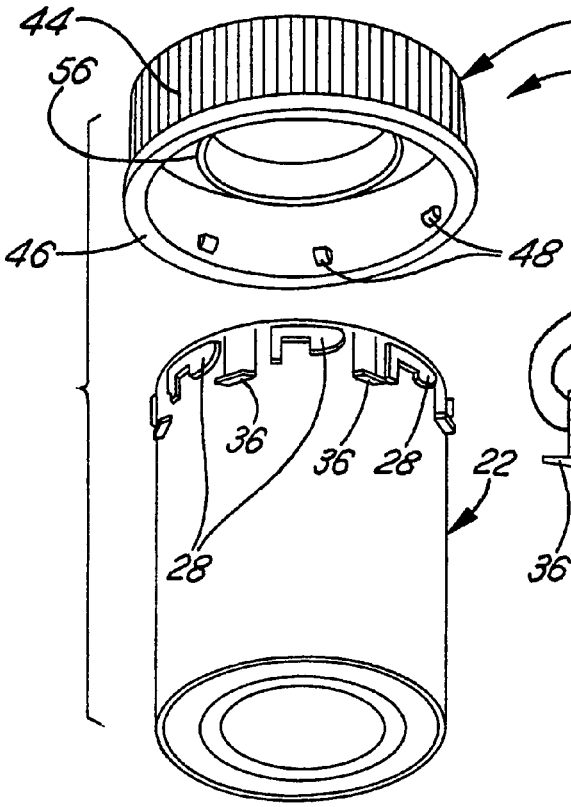
FIG. 1 is an exploded perspective view of a closure and container package in accordance with a presently preferred embodiment of the invention.
Figure 3:
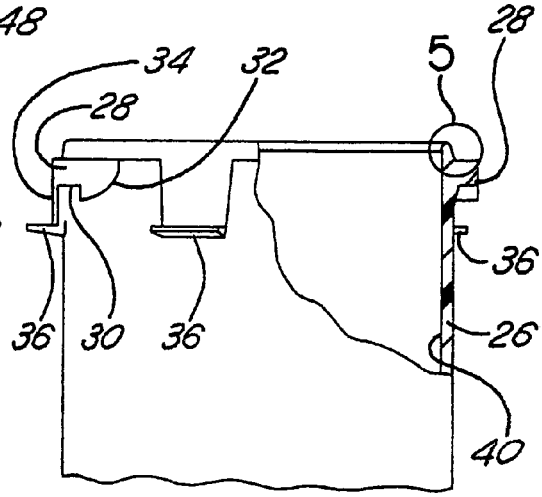
FIG. 3 is a partially sectioned fragmentary elevational view of the container in the package of FIGS. 1 and 2.
Figure 4:
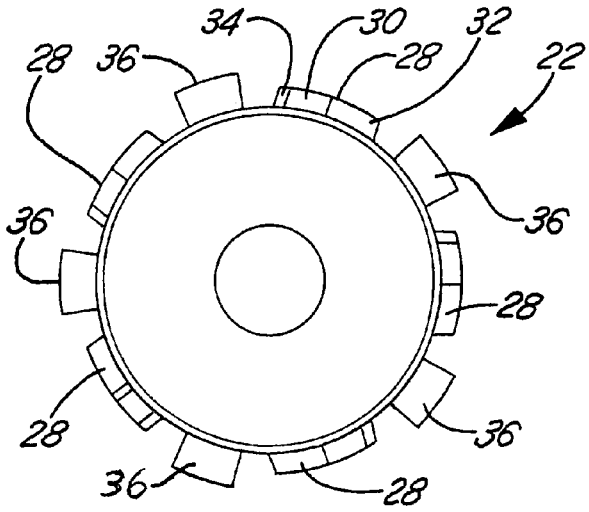
FIG. 4 is a bottom plan view of the container in the package of FIGS. 1 and 2.
Figure 5:
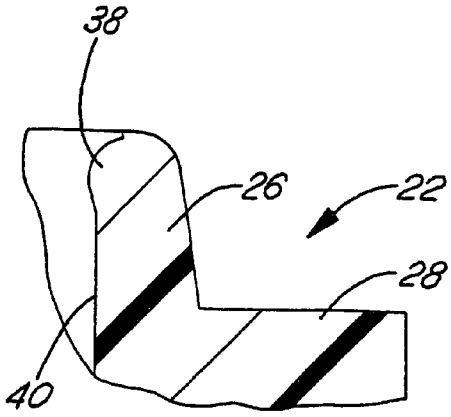
FIG. 5 is an enlarged view of the portion of FIG. 3 within the circle 5.
Figure 6:
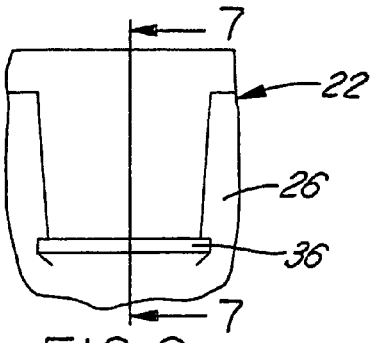
FIG. 6 is a fragmentary view on an enlarged scale of a spring element in the container of FIGS. 3–4.
Figure 7:
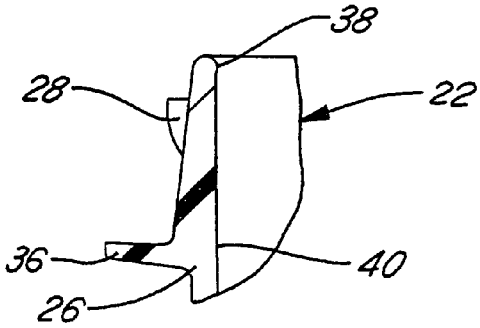
FIG. 7 is a fragmentary sectional view taken substantially along the line 7—7 in FIG. 6.

FIG. 1 illustrates a closure and container package 20 that is particularly well suited for use as a prescription package. Package 20 includes a container or vial 22 and a closure 24 for securement to the container. Referring to FIGS. 1–8, container 22 includes a cylindrical wall 26 having an open upper end that defines the mouth of the container. A plurality of circumferentially spaced projections 28 extend radially outwardly from the outer surface of cylindrical wall 26 at a position adjacent to the open end of the container. Each projection 28 includes a downwardly open notch 30 on the underside of the projection, a convex cam surface 32 on one side of the notch, and an abutment stop 34 on the opposing side of the notch. (It will be appreciated that directional words such as "upper" and "lower" are employed by way of description and not limitation with respect to the orientation of the closure and container illustrated in FIGS. 1–7. Directional words such as "axial" and "radial" are employed by way of description and not limitation with reference to the central axis of the cylindrical sidewall 26 that surrounds the container opening.) A plurality of circumferentially spaced flexible resilient spring elements 36 extend radially outwardly from the outer surface of wall 26 and are angularly disposed between projections 28 in plan view, as best seen in FIGS. 1 and 3–4. Spring elements 36 comprise essentially flat spring tabs that are molded integrally with container 22. The spring tab elements are disposed in a plane that is perpendicular to the axis of container wall 26 and positioned on a side of projections 28 that is opposite from the open end of the container. An internal bead 38 extends radially inwardly from container wall 26 at the open end of the container. Bead 38 preferably is circumferentially continuous around wall 26. As best seen in FIG. 5, bead 38 in the preferred embodiment of the invention extends radially inwardly from the cylinder of revolution that defines internal surface 40 of wall 26. Bead 38 may alternatively be formed by an undercut in surface 40 of wall 26, so that the radially inner edge of bead 0.38 is on the cylinder of revolution of surface 40. Bead 38 is rounded in profile, as best seen in FIG. 5.

Figure 2:
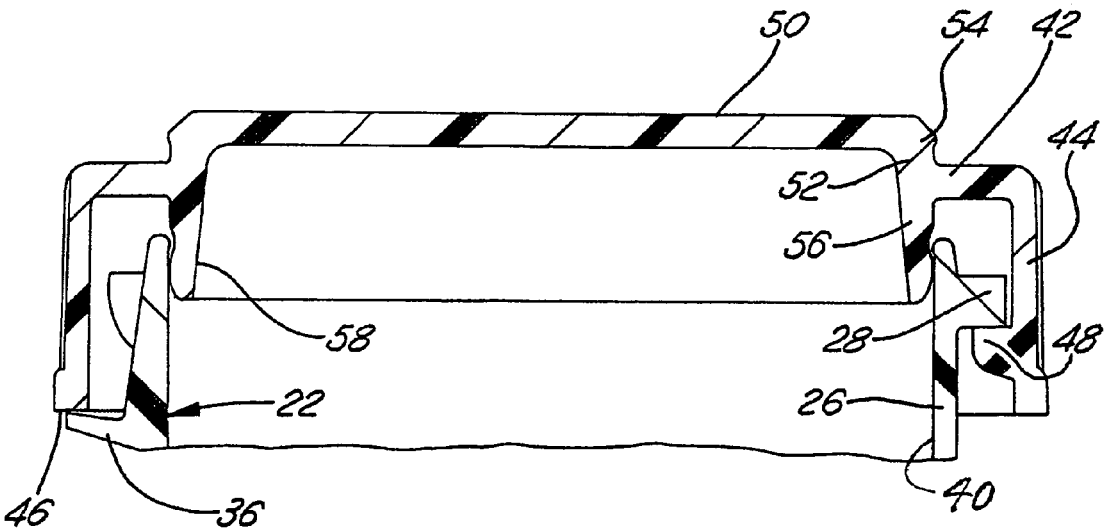
FIG. 2 is a fragmentary sectional view of the closure assembled to the container in the package of FIG. 1.
Figure 8:
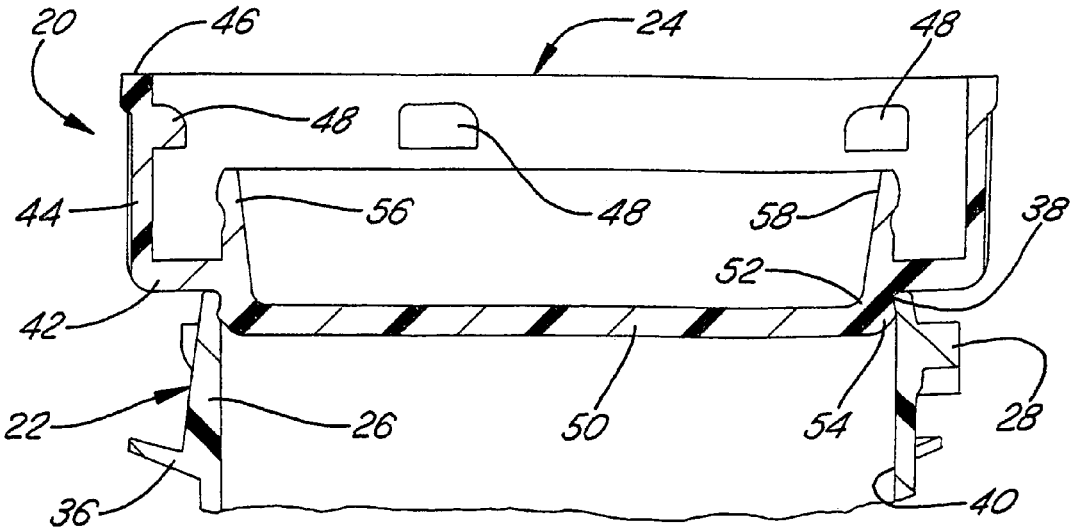
FIG. 8 is a fragmentary sectional view of the closure and container package with the closure mounted to the container in a non-child-resistant mode of operation.

Closure 24 includes a base wall 42 and a cylindrical skirt 44 extending from a peripheral edge of the base wall to an axial skirt edge 46 disposed in a plane parallel to and spaced from base wall 42. A plurality of circumferentially spaced lugs 48 extend radially inwardly from skirt 44. A hollow dome 50 extends axially from base wall 42 coaxially with skirt 44 and in an opposite direction from skirt 44. Dome 50 has an annular sidewall 52 spaced radially inwardly from the peripheral edge of base wall 42 and a flat top wall that is parallel to base wall 42. A bead 54 extends radially outwardly from annular wall 52. Bead 54 preferably is circumferentially continuous around dome 50, and lies in a plane parallel to but spaced from base wall 42. Bead 54 preferably is rounded in profile, as best seen in FIG. 2. A circumferentially continuous annular wall 56 extends axially from base wall 42 coaxially with and spaced radially inwardly from skirt 44. The inside surface 58 of annular wall 56 preferably forms a continuation of the inside surface of annular sidewall 52 in the embodiment of FIGS. 1–8. Surface 58 preferably is conical in geometry, as best seen in FIGS. 2 and 8. Wall 56 narrows from base wall 42 to the free end of the wall spaced from base wall 42, and is radially flexible and resilient, for purposes to be described. Container 22 and closure 24 are each of one-piece construction of suitable molded plastic material, such as polypropylene.

In a child-resistant mode of operation illustrated in FIGS. 1 and 2, skirt 44 is telescopically received over the open end of container sidewall 26 until edge 46 of skirt 44 engages the opposing upper surfaces of spring elements 36. Closure 24 is then rotated clockwise, so that lugs 48 on closure skirt 44 ride along cam surfaces 32 of container projections 28. Downward movement of the closure flexes spring elements 36 axially downwardly until lugs 48 snap into notches 30. Abutments 34 prevent continued clockwise rotation of the closure. Annular wall 56 is received within the open end of container 22 and is flexed radially inwardly to form a firm internal plug seal with the open end of the container. Thus, both the sealing function and the spring function of the closure insert element(s) in the prior art are served in the two-piece closure and container assembly, reducing the number of elements in the assembly and thereby reducing assembly costs. When it is desired to remove closure 24 from container 22, the closure is pressed downwardly against the resilient force of spring elements 36 until lugs 48 clear notches 30. The closure is then rotated counterclockwise until the notches clear the projections, and the closure is removed from the container.

In a non-child-resistant mode of operation illustrated in FIG. 8, closure 24 is inverted and dome 50 is inserted into the open end of container 22. Bead 54 on dome 50 is received by snap fit over bead 38 on container sidewall 26. The position of bead 38 with respect to the open end of the container preferably is coordinated with the position of bead 54 on dome 50 so that the rounded contours of the beads bring the axial edge of the container into abutment with base wall 42 on closure 24. In this configuration, the inside of the container remains sealed, but the closure may be readily removed by elderly or handicapped persons, for example.

Figure 9:
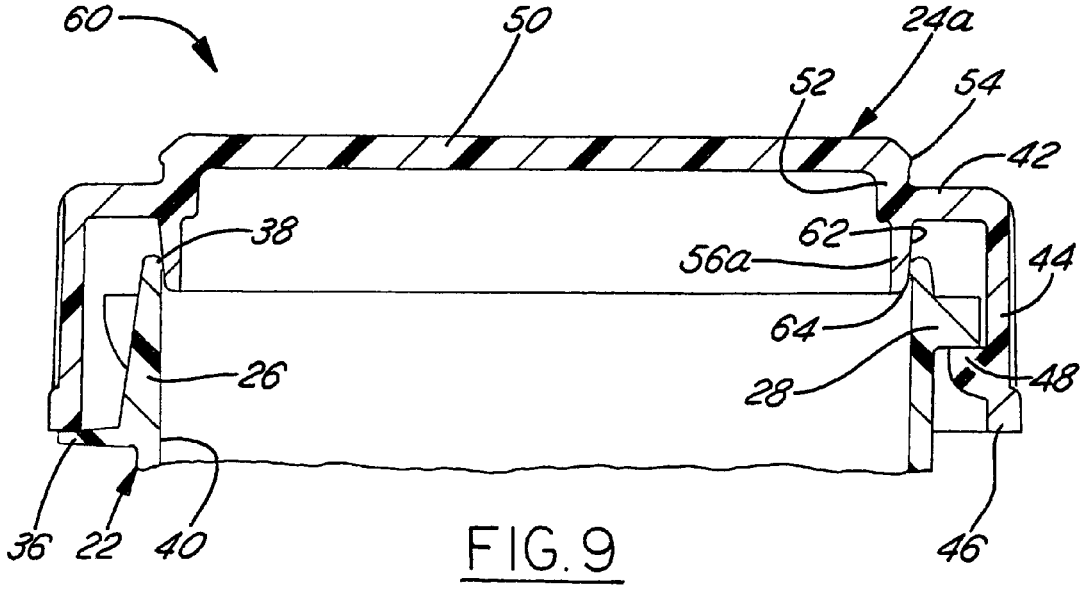
FIG. 9 is a fragmentary sectional view of a closure and container package in accordance with another embodiment of the present invention.
Figure 10:
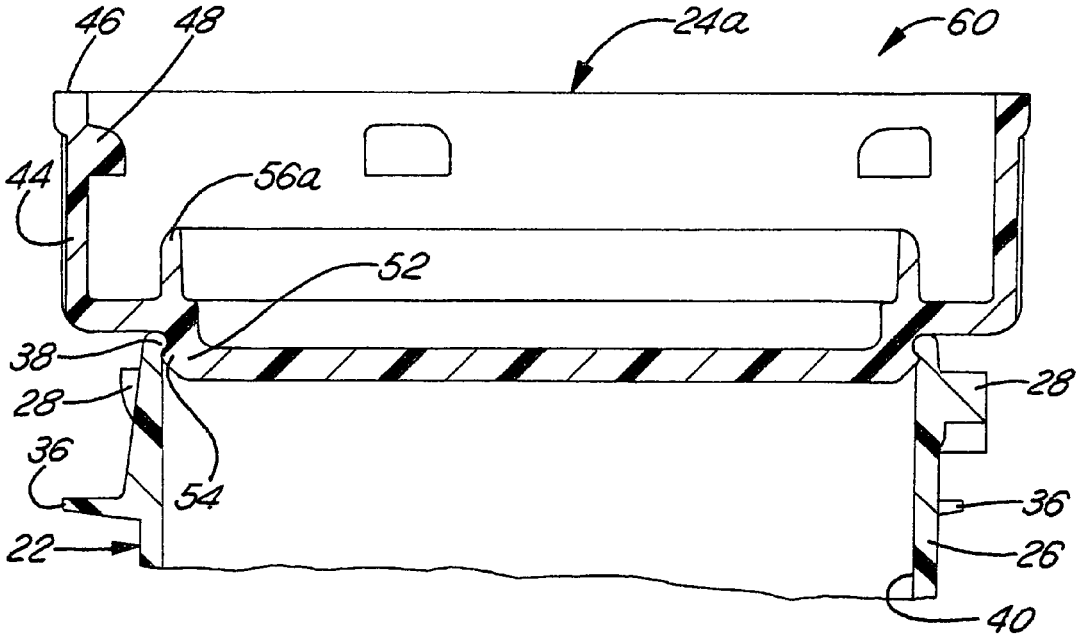
FIG. 10 is a fragmentary sectional view of the package of FIG. 9 in a non-child-resistant mode of operation.

FIGS. 9 and 10 illustrate a closure and container package 60 in accordance with a modified embodiment of the invention in respective child-resistant and non-child-resistant modes of operation. Reference numerals in FIGS. 9 and 10 that are identical to those in FIGS. 1–8 indicate identical components, and modified components are indicated by identical reference numerals followed by the suffix "a." Package 60 includes a container or vial 22 and a closure 24*a*. Closure 24*a* is basically the same as closure 24 in FIGS. 1–8, except that annular wall 56*a* is stepped radially outwardly from wall 52 in closure 24*a*. Wall 56*a* has a smooth outer surface 62 and a rounded lower end 64 for plug-sealing receipt within bead 38 of the container finish in the child-resistant mode of operation in FIG. 9. In the non-child-resistant mode of operation illustrated in FIG. 10, closure 24*a* operates the same as closure 24 discussed above in connection with FIG. 8.

There have thus been disclosed a closure and container package, a closure, a container, and a method of making a closure and container package, that fully achieve all of the objects and aims previously set forth. The invention has been disclosed in connection with a presently preferred embodiment of the invention, and a number of modifications and variations have been discussed. Other modifications and variations will readily suggest themselves to persons of ordinary skill in the art. The invention is intended to embrace all such modifications and variations as fall within the spirit and broad scope of the appended claims.

The invention claimed is:

1. A child-resistant closure and container package that comprises:

a one-piece container having an open end surrounded by a cylindrical wall with a central axis and a cylindrical outer surface, a plurality of circumferentially spaced projections extending radially outwardly from said cylindrical outer surface of said wall adjacent to said open end, notches on undersides of said projections, and a plurality of circumferentially spaced flexible resilient spring elements extending radially outwardly from said cylindrical outer surface of said wall and angularly disposed between said projections, and a closure that includes a base wall, a cylindrical skirt extending from said base wall to an axial edge spaced from said base wall, a plurality of circumferentially spaced lugs extending radially inwardly from said skirt, and a circumferentially continuous annular wall extending axially from said base wall coaxially with and spaced radially inwardly from said skirt, said axial edge of said cylindrical skirt being adapted for axial edge abutment with said spring elements at positions on said spring elements spaced radially outwardly from said cylindrical outer surface to urge said lugs axially into said notches with said annular wall being in internal plug-sealing engagement with said open end of said container, removal of said closure requiring axial movement of said closure against said spring elements and rotation of said closure to move said lugs out of said notches.

2. The package set forth in claim 1 wherein said closure further comprises a second annular wall extending from said base wall axially opposite said skirt, said second annular wall having a circumferential bead for securing said closure to said open end of said container in a non-child-resistant mode of operation.

3. The package set forth in claim 2 wherein said circumferential bead extends radially outwardly from said second annular wall for internal engagement with said cylindrical wall within said open end.

4. The package set forth in claim 1 wherein said spring elements lie in a plane perpendicular to said axis and disposed on an opposite side of said projections from said open end of said container.

5. A closure and container package having child-resistant and non-child-resistant modes of operation, which comprises:

a one-piece container having an open end surrounded by a cylindrical wall with a central axis and a cylindrical outer surface, a plurality of circumferentially spaced projections extending radially outwardly from said cylindrical outer surface of said wall adjacent to said open end, notches on undersides of said projections, a plurality of circumferentially spaced flexible resilient flat spring elements extending radially outwardly from said cylindrical outer surface of said wall in a plane perpendicular to said axis on an opposite side of said projections from said open end and angularly disposed between said projections, and an internal bead around said open end, and a closure including a base wall, a cylindrical skirt extending from a peripheral edge of said base wall to an axial edge spaced from said base wall, a plurality of circumferentially spaced lugs extending radially inwardly from said skirt, a hollow dome extending axially from said base wall in a direction opposite from said skirt, said dome having an annular sidewall spaced radially inwardly from said peripheral edge of said base wall, a bead extending radially outwardly from said annular wall at a position spaced from said base wall, and a circumferentially continuous annular wall extending axially from said base wall coaxially with and spaced radially inwardly from said skirt, said closure being adapted to be secured to said container in a child-resistant mode of operation with said axial edge of said cylindrical skirt in axial edge engagement with said spring elements at positions on said spring elements spaced radially outwardly from said cylindrical outer surface to urge said lugs axially into said notches and with said annular wall in internal plug-sealing engagement with said open end of said container, said closure being adapted to be secured to said container in a non-child-resistant mode of operation with said dome received within said open end and said bead on said annular sidewall received by snap fit over said internal bead on said cylindrical wall.

6. The package set forth in claim 5 wherein said beads on said container and closure are circumferentially continuous.

7. The package set forth in claim 6 wherein said bead on said closure lies in a plane parallel to said base wall.

8. The package set forth in claim 7 wherein said beads are rounded in profile.

9. The package set forth in claim 8 wherein spacing between said bead and said base wall on said closure, and between said bead and said end of said container, are such that snap-fit of said bead on said closure over said bead on said container brings said base wall into abutting engagement with said end of said container.

10. A container of one-piece plastic construction having an open end surrounded by a cylindrical wall with a central axis and a cylindrical outer surface, a plurality of circumferentially spaced projections extending radially outwardly from said cylindrical outer surface of said wall adjacent to said open end, notches on undersides of said projections, and a plurality of circumferentially spaced flexible resilient spring elements extending radially outwardly from said cylindrical outer surface of said wall and angularly disposed between said projections.

11. The container set forth in claim 10 wherein said spring elements are flat and lie in a plane perpendicular to said axis and disposed on an opposite side of said projections from said open end of said container.

12. A container of one-piece plastic construction having an open end surrounded by a cylindrical wall with a central axis and a cylindrical outer surface, a plurality of circumferentially spaced projections extending radially outwardly from said cylindrical outer surface of said wall adjacent to said open end, notches on undersides of said projections, a plurality of circumferentially spaced flexible resilient flat spring elements extending radially outwardly from said cylindrical outer surface of said wall in a plane perpendicular to said axis on an opposite end of said projections from said open end and angularly disposed between said projections, and an internal bead around said open end.

13. A method of making a closure and container package that comprises:

(a) providing a one-piece container having an open end surrounded by a cylindrical wall with a central axis and a cylindrical outer surface, a plurality of circumferentially spaced projections extending radially outwardly from said cylindrical outer surface of said wall adjacent to said open end, notches on undersides of said projections, and a plurality of circumferentially spaced flexible resilient spring elements extending radially outwardly from said cylindrical outer surface of said wall and angularly disposed between said projections, (b) providing a closure that includes a base wall, a cylindrical skirt extending from said base wall to an axial edge spaced from said base wall, a plurality of circumferentially spaced lugs extending radially inwardly from said skirt, and a circumferentially continuous annular wall extending axially from said base wall coaxially with and spaced radially inwardly from said skirt, and (c) assembling said closure to said container by engaging said axial edge of said cylindrical skirt against said spring elements at positions on said spring elements spaced radially from said cylindrical outer surface and rotating said closure until said lugs engage said notches on said undersides of said projections.

* * * * *